US005165339A

United States Patent [19]

Hoffman et al.

[11] Patent Number: 5,165,339

[45] Date of Patent: Nov. 24, 1992

[54] DETACHABLE SCRAPER ATTACHMENT FOR A FLOOD BAR

[75] Inventors: Richard Hoffman, Chicago; Aleksander Szyszko, Carol Street, both of Ill.

[73] Assignee: M & R Printing Equipment, Inc., Glen Ellyn, Ill.

[21] Appl. No.: 581,003

[22] Filed: Sep. 12, 1990

[51] Int. Cl.[5] ..... B41L 13/18

[52] U.S. Cl. ..... 101/123; 101/169

[58] Field of Search ..... 101/114, 119, 121, 123, 101/124, 126, 129, 120, 157, 169; 15/256.5, 256.51; 118/71, 256, 261, 301, 326; 355/299; 427/282; 37/117.5, 253, 264, 265, 266, 267, 269, 272, 274, 275, 279-281; 172/782, 784, 799.5

[56] References Cited

U.S. PATENT DOCUMENTS

| | | | |
|---|---|---|---|
| 2,881,698 | 4/1959 | Graham | 101/123 |
| 3,955,501 | 5/1976 | Bubley et al. | 101/123 |
| 3,988,986 | 11/1976 | Zimmer | 101/123 X |
| 4,080,893 | 3/1978 | Wedell | 101/124 |
| 4,102,266 | 7/1978 | Porth | 101/124 |
| 4,121,519 | 10/1978 | Porth | 101/124 |
| 4,216,716 | 8/1980 | Zimmer | 101/120 |
| 4,389,936 | 6/1983 | Jaffa et al. | 101/123 |
| 4,509,455 | 4/1985 | Shirataki | 118/696 |
| 4,819,349 | 4/1989 | Mensch | 37/117.5 |
| 4,836,356 | 6/1989 | Mukai et al. | 15/256.5 X |

*Primary Examiner*—Edgar S. Burr
*Assistant Examiner*—Moshe I. Cohen
*Attorney, Agent, or Firm*—Wallenstein, Wagner & Hattis, Ltd.

[57] ABSTRACT

A detachable scraper attachment for a flood bar having a pair of opposing opposite edges comprising a portion adapted to mount on a portion of the flood bar holder, a flange having an upper and lower edge, the lower edge being generally arcuate, the upper edge attached to the channel portion, and means for detachably affixing the scraper attachment to the edges of the flood bar.

10 Claims, 2 Drawing Sheets

DETACHABLE SCRAPER ATTACHMENT FOR A FLOOD BAR

TECHNICAL FIELD OF THE INVENTION

The present invention relates to the field of screen printing. More specifically, the present invention relates to a detachable scraper attachment to a flood bar.

BACKGROUND OF THE INVENTION

Printed indicia which are applied to T-shirts and other articles of clothing have become very popular in the last decade. Boutiques which specialize in printing fanciful indicia such as slogans, college names, or sports team names on T-shirts and other clothing, are commonly seen in shopping malls. The indicia available at these boutiques can be pre-printed on a substrate and applied with a heated press by operators at these boutiques to articles of clothing purchased by the consumer, or can be screen printed directly on an article of clothing.

In the screen printing process, a stencil screen embodying the indicia is placed over the object to be printed. Ink of one color is then flooded onto the screen by a flood bar of conventional design. The ink is of the type well-known in the industry for screen printing. After the ink is flooded onto the screen, the ink is squeegeed through the screen onto the object leaving ink of the desired color where the interstices in the screen appeared. The squeegee is of any type well-known in the art.

As the ink is flooded onto the screen, and during the print stroke, the ink tends to be forced to the edges of the screen between the ends of the squeegee and flood bar and the screen frame. This results in ink buildup which is not utilized in the printing process and is wasted. The operator must periodically scrape up the ink from the edges of the screen and place it in front of the flood bar. At cleanup time, the operator must clean the screen of all ink so that it may be reused. The ink deposits along the frame significantly increase the time required for cleanup, particularly if the ink has dried. The operator must use a spatula or putty knife to scrape the ink from the edges and then wash the area with solvents.

In an attempt to automatically prevent the ink from collecting at the edges of the screen, flood bars with integral scrapers have been developed. The scrapers work to scrape the ink from the edges of the screen automatically while the flood bar moves along the screen during the flood stroke. The integral contoured scrapers generally work, but requires the purchase of entire sets of flood bar and scraper assemblies in various sizes and lengths which can be quite expensive since different sizes of screens and indicia are used. They also do not permit the versatility or reusability of the present invention.

A need has developed for an inexpensive detachable scraper attachment which can be retrofitted to any existing flood bar. A need has also developed for a reusable scraper. The present invention solves these and other problems.

SUMMARY OF THE INVENTION

The detachable scraper attachment of the present invention comprises a portion adapted to mount on a portion of the flood bar holder, a flange having an upper and lower edge, the lower edge being generally arcuate, the upper edge attached to the channel portion, and means for detachably affixing the scraper attachment to the edges of the flood bar.

An object of the present invention is to provide a simple and inexpensive detachable apparatus for recovering ink which collects at the edges of a screen during the printing process. The present invention allows less ink to be used during the flooding process, thereby also reducing waste.

The present invention also decreases production time by continuously scraping ink from the edges of the screen, obviating the need for the operator to stop the process to do so manually. It also reduces cleanup time as less ink collects along the margins of the screen, and lessens the chance of injury to the operator who tries to scrape the ink into the path of a moving flood bar.

Other advantages and aspects of the invention will become apparent upon making reference to the specification, claims, and drawings to follow.

DETAILED DESCRIPTION OF THE INVENTION

Figure 1:
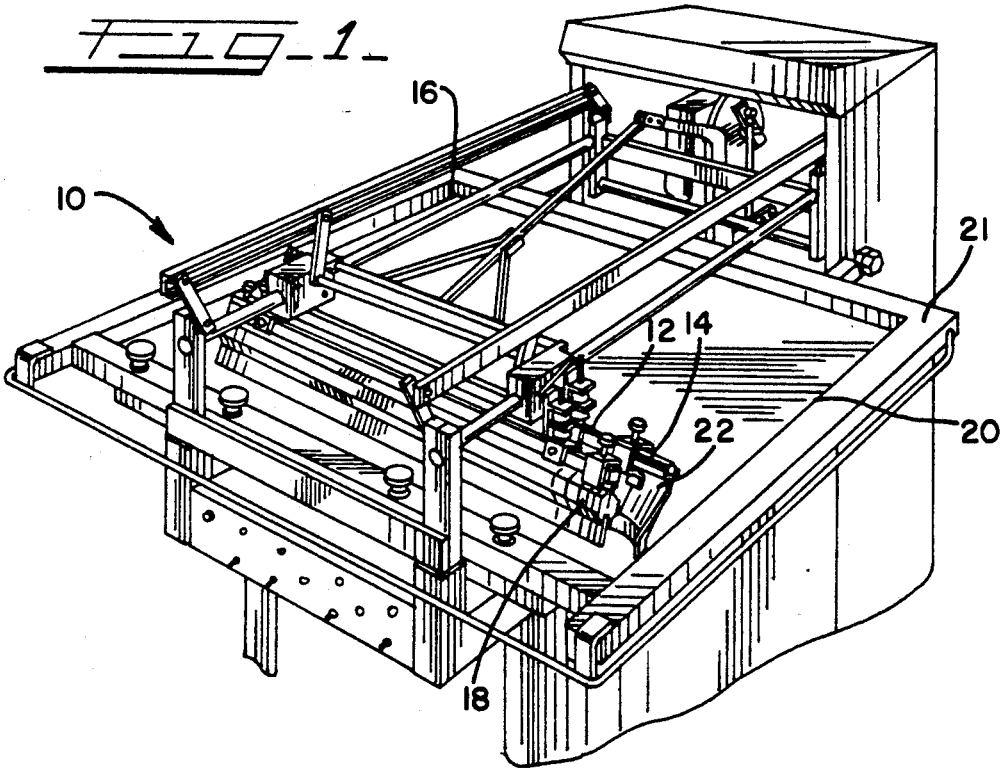
FIG. 1 is a perspective view of a typical print station of a printing press showing the flood and squeegee bars with the present invention attached to the flood bar.

While this invention is susceptible of embodiment in many different forms, there is shown in the drawings and will herein be described in detail, a preferred embodiment of the invention with the understanding that the present disclosure is to be considered as an exemplification of the principles of the invention, and is not intended to limit the broad aspect of the invention to the embodiment illustrated.

Figure 2:
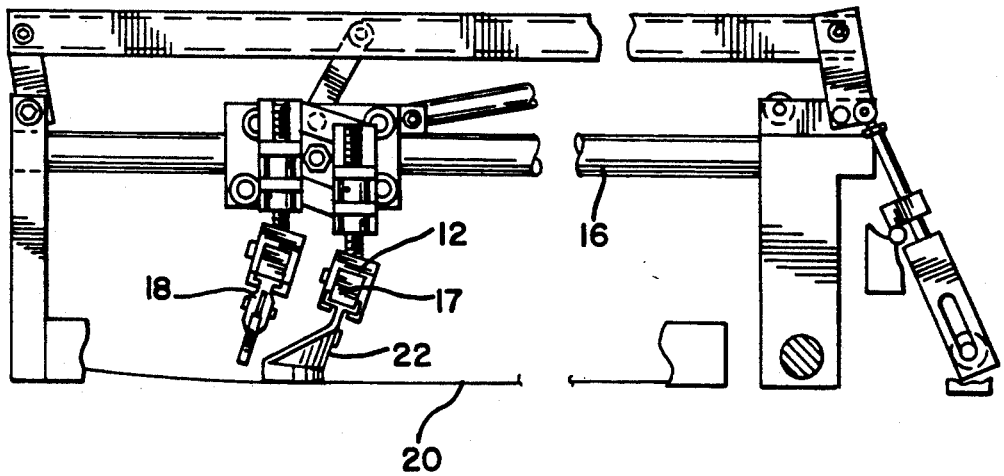
FIG. 2 is a side view of the typical print station of FIG. 1 showing the present invention attached to the flood bar.
Figure 3:
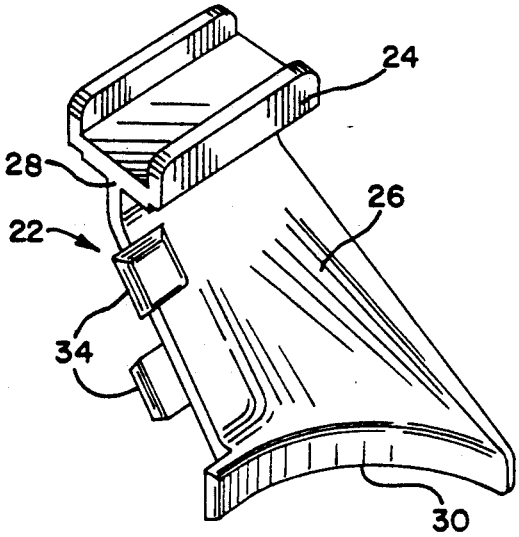
FIG. 3 is a perspective view of the scraper attachment of the present invention.
Figure 4:
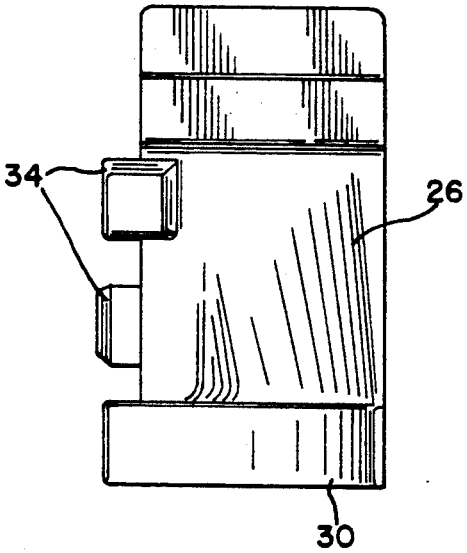
FIG. 4 is a rear view of the scraper attachment of the present invention.
Figure 5:
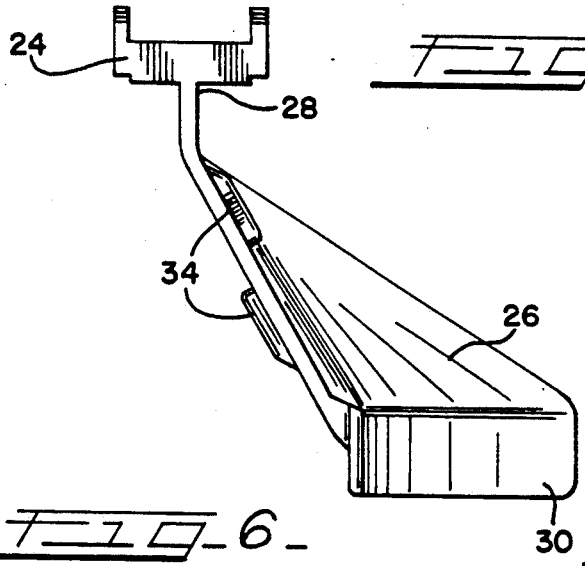
FIG. 5 is a side view of the scraper attachment of the present invention.
Figure 6:
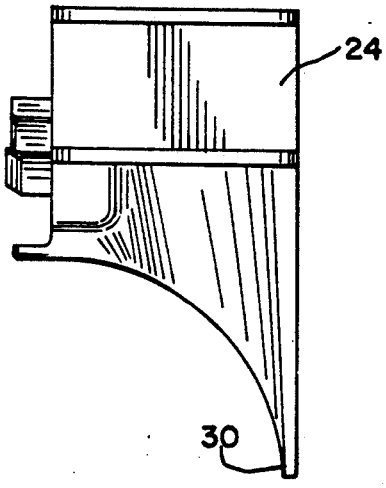
FIG. 6 is a top view of the scraper attachment of the present invention.
Figure 7:
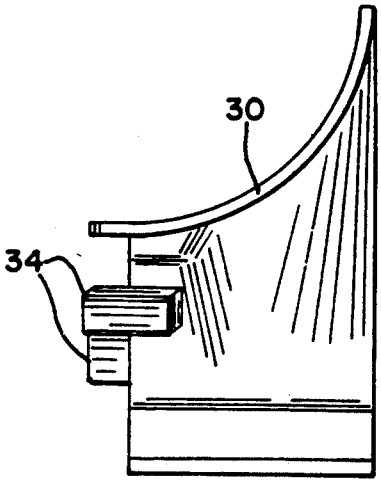
FIG. 7 is a bottom view of the scraper attachment of the present invention.

Referring now to the drawings, FIGS. 1 and 2 disclose a typical print station 10 of a screen printing press. A flood bar 12 having opposing outer edges 14 is slidably mounted on a radial arm 16. The flood bar 12 is mounted on a flood bar holder 17. A squeegee 18 is positioned directly behind the flood bar 12. To print indicia on an object, a screen 20 having a frame 21 along its edges is placed at the print station 10 on a bed (not shown) beneath the flood bar 12 and squeegee 18. The screen 20 is placed over the object to be printed and the ink flooded by the flood bar 12 on the forward stroke and the ink squeegeed through the screen 20 by the squeegee 18 on the return stroke.

FIGS. 1 and 2 disclose the scraper 22 of the present invention attached to an edge of the flood bar 12. The scraper 22 may be attached to the flood bar using any conventional means but is preferably clamped to the flood bar 12 as shown in FIG. 1.

To print indicia on an object, the flood bar 12 and squeegee 18 move along the radial arm 16. On an initial stroke, the flood bar 12 deposits ink onto the screen 20 in a conventional manner. On the return stroke, the squeegee 18 moves along the screen forcing ink into interstices stencilled into the screen 20. While the squeegee 18 passes over the screen 20, ink is forced to outer edges of the screen 20.

FIGS. 3–7 disclose the preferred embodiment of the scraper 22 of the present invention. The scraper 22, preferably, has a generally U-shaped channel portion 24 which is adapted to mount on the upper portion of the flood bar holder 17. The scraper 22 also has a flange 26 having an upper edge 28 and a lower edge 30. The upper edge 28 is preferably straight and is longitudinally attached to the base of the channel portion 24 such that the flange 26 extends below the channel portion 24. The lower edge 30 of the flange 26 is preferably arcuate such that it comprises approximately one quarter of a circle. The flange 26 flares from the upper edge 28 to the lower edge 30.

Preferably attached to a non-flared edge of the flange 26 is a means for affixing the scraper 22 to the flood bar 12. The affixing means preferably comprises a pair of tabs 34. The tabs 34 preferably extend from opposing surfaces of the flange 26. The tabs 34 are adapted to fittingly accept an outer edge 14 of the flood bar 12 therebetween. The tabs 34 connect the scraper 22 to the flood bar 12. The scraper 22 is then preferably clamped to the flood bar 12 at the channel portion 24 to further secure it to the flood bar 12. One scraper 22 is attached to each opposing edge or end 14 of the flood bar 12.

The scrapers 22 attached to the edges 14 of the flood bar 12 preferably extend to edges of the screen 20 and closely adjacent the screen frame 21. As the ink is deposited onto the screen 20, the arcuate edge 30 of the scraper 22 acts to force ink which was moved to the outside of the screen 20 by the squeegee 18 toward the center of the screen 20. This allows the scrapers 22 to reach the edges of the screen 20 where ink tends to collect and prevents buildup of ink. It also reduces the amount of ink necessary for a print by keeping the ink concentrated in the print area rather than building up along the frame 21. The scraper 22 is preferably made of a non-corrosive material such as polyurethane or other inert material. This allows the scraper to be reused for a long period of time and facilitates cleanup by conventional solvents.

While the specific embodiments have been illustrated and described, numerous modifications come to mind without significantly departing from the spirit of the invention, and the scope of protection is only limited by the scope of the accompanying claims.

I claim:

1. A flood bar assembly for use in a screen printer comprising:

a flood bar having a pair of opposite edges;

means for holding said flood bar;

a screen scraper having a mounting portion adapted to mount on a portion of said flood bar holding means, a flange having an upper and a lower edge, said lower edge being generally arcuate, said upper edge being attached to same mounting portion; and affixing means for detachably affixing said scraper to said opposite edges of said flood bar.

2. The assembly of claim 1 wherein said affixing means comprises a pair of tabs extending from opposing surfaces of the flange adapted to fittingly accept an edge of the flood bar therebetween.

3. The assembly of claim 1 wherein said portion is a generally U-shaped channel.

4. The assembly of claim 1 wherein said upper edge of said flange is straight and is attached longitudinally to said portion, such that said flange extends below said portion.

5. The assembly of claim 1 wherein said scraper is made of a non-corrosive material.

6. The scraper attachment of claim 5 wherein said non-corrosive material is polyurethane.

7. A flood bar assembly for use with a screen printer having a screen with a plurality of edges and an upper surface comprising:

flood bar means including an elongated flood bar having outer ends for dispensing ink to said upper surface, said flood bar means including first mounting means for mounting said flood bar for reciprocating movement in first and second opposing directions above said screen and parallel to said surface;

scraper means for wipingly engaging said upper surface; and second mounting means for removably mounting said scraper means to said flood bar means proximate to a given one of said flood bar ends, said scraper means being configured to wipingly drive ink residing on said upper surface in a direction away from the closest of said edges to said scraper means and towards central portions of said screen when said flood bar means is driven in one of said opposing directions.

8. The assembly of claim 7 including a pair of said scraper means each mountable proximate to a different end of said flood bar.

9. The assembly of claim 7 wherein said screen includes at least one pair of generally linear parallel raised screen edges, said first mounxting means is configured to provide said reciprocating movement parallel to said pair of screen edges, and said second mounting means provides for mounting said scraper means proximate to a given one of said pair of screen edges.

10. The assembly of claim 9 including a pair of said scraper means each mountable proximate to a different one of said pair of screen edges.

* * * * *

UNITED STATES PATENT AND TRADEMARK OFFICE

CERTIFICATE OF CORRECTION

PATENT NO. : 5,165,339

DATED : November 24, 1992

INVENTOR(S) : Hoffman et al.

It is certified that error appears in the above-identified patent and that said Letters Patent is hereby corrected as shown below:

Column 4, line 6, Claim 1, delete "same" and insert --said--.

Column 4, line 21, Claim 6, delete "scraper attachment" and insert --assembly--.

Column 4, line 49, Claim 9, delete "mounxting" and insert --mounting--.

Signed and Sealed this

Twenty-sixth Day of October, 1993

*Attest:*

Bruce Lehman

BRUCE LEHMAN

*Attesting Officer*

*Commissioner of Patents and Trademarks*